US007934950B2

(12) United States Patent
Yong

(10) Patent No.: US 7,934,950 B2
(45) Date of Patent: May 3, 2011

(54) CONNECTOR WITH GUIDE RIBS AND REINFORCING RIBS

(75) Inventor: Zhu Yong, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/570,273

(22) Filed: Sep. 30, 2009

(65) Prior Publication Data

US 2010/0112841 A1 May 6, 2010

(30) Foreign Application Priority Data

Nov. 5, 2008 (JP) ..... 2008-284528
Nov. 5, 2008 (JP) ..... 2008-284544

(51) Int. Cl.
*H01R 13/73* (2006.01)

(52) U.S. Cl. ..... 439/559

(58) Field of Classification Search ..... 439/559, 439/926, 206, 607.28, 607.05, 607.41
See application file for complete search history.

(56) References Cited

U.S. PATENT DOCUMENTS

| | | | | |
|---|---|---|---|---|
| 6,338,651 | B1 * | 1/2002 | Svette et al. | 439/559 |
| 6,837,728 | B2 * | 1/2005 | Miyazaki et al. | 439/271 |
| 7,090,533 | B1 * | 8/2006 | Houck et al. | 439/553 |
| 7,094,098 | B2 * | 8/2006 | Miyazaki | 439/559 |
| 7,614,910 | B2 * | 11/2009 | Croteau et al. | 439/573 |
| 2010/0009566 | A1 * | 1/2010 | Sakakura et al. | 439/364 |

FOREIGN PATENT DOCUMENTS

| | | |
|---|---|---|
| JP | 2002-313496 | 10/2002 |
| JP | 2003-179381 | 6/2003 |

* cited by examiner

*Primary Examiner* — Phuong K Dinh
(74) *Attorney, Agent, or Firm* — Gerald E. Hespos; Michael J. Porco

(57) ABSTRACT

A connector (10) for an apparatus includes a housing (11) having a fit-in part (41) to be fit in a mounting hole (33) that penetrates through a case (30) of the apparatus. Tubular terminal insertion parts (42), penetrating through the fit-in part (41) and can receive a terminal fitting (21) connected with an end of a wire (20). Guide ribs (46A-46C) project from the fit-in part (41) into the case (30) and are spaced apart around an inner peripheral surface of the mounting hole (33). Reinforcing ribs (45A-45D) projecting into the case (30) Each reinforcing rib (45A-45D) and connects a side edge of a guide rib (46A-46C) to a peripheral surface of a terminal insertion part (42).

14 Claims, 13 Drawing Sheets

CONNECTOR WITH GUIDE RIBS AND REINFORCING RIBS

BACKGROUND OF THE INVENTION

1. Field of the Invention

The invention relates to a connector to be mounted on a case of an apparatus.

2. Description of the Related Art

Japanese Patent Application Laid-Open No. 2003-179381 discloses a connector to be mounted on a case of an apparatus, such as an inverter. A mounting hole penetrates the case of the apparatus and the connector has a housing with a fit-in part that can be fit in the mounting hole. A tubular terminal insertion part penetrates through the fit-in part and a terminal connected to the end of an electric wire is inserted through the terminal insertion part. A reinforcing rib is connected with the peripheral surface of the terminal insertion part and projects into the case to prevent the terminal insertion part from inclining. A tapered guide is formed on a side edge of the reinforcing rib opposed to the inner peripheral surface of the mounting hole and slidingly contacts the inner peripheral surface of the mounting hole when fitting the fit-in part in the mounting hole to prevent the housing from inclining The tapered guide causes the reinforcing rib to be smaller and thus reduces the strength of the reinforcing rib.

Japanese Patent Application Laid-Open No. 2002-313496 also discloses a connector to be mounted on a case of an apparatus such as an inverter. A mounting hole penetrates through the case of the apparatus and the connector has a housing with a fit-in part to be fit in the mounting hole. A part of the housing projects from one-end of the fit-in part and is exposed outside the case. A shielding shell surrounds the exposed portion of the housing and is fixed to the case. A shell contact surface is provided at one-end of the fit-in part in the direction in which the fit-in part is fit in the mounting hole and is capable of contacting the shielding shell.

The shielding shell is fixed to the case so that the shell contact surface closely contacts the shielding shell with no gap between the shielding shell and the shell contact surface. However, a slight gap may be formed between the shielding shell and the shell contact surface depending on a fit-in depth of the fit-in part in the mounting hole when the shielding shell is fixed to the case. Water easily collects in such a gap between the shielding shell and the housing.

The invention has been completed in view of the above-described situations. Accordingly, an object of the invention while to prevent a housing from inclining and while enhancing the strength of a reinforcing rib.

A further object of the invention is to make it difficult for water to collect between a shielding shell and a housing.

SUMMARY OF THE INVENTION

The invention relates to a connector with a housing that has a fit-in part to be fit in a mounting hole that penetrates through a case of an apparatus. At least one tubular terminal insertion part penetrates through the fit-in part and can receive a terminal fitting connected with an end of an electric wire is inserted. Guide ribs project from the fit-in part into the case and are spaced circumferentially along an inner peripheral surface of the mounting hole. Reinforcing ribs also project into the case. Each reinforcing rib connects a side edge of one of the guide ribs to a peripheral surface of the terminal insertion part.

The reinforcing ribs prevent the terminal insertion part from inclining. The guide ribs slidingly contact the inner peripheral surface of the mounting hole to prevent the housing from inclining and to guide the fit-in part into the mounting hole. The guide ribs couple adjacent reinforcing ribs are coupled to each other and enhance the strength of the reinforcing ribs.

The guide ribs may have the same outer configuration as the fit-in part. Thus, the guide ribs can be disposed in the vicinity of the inner peripheral surface of the mounting hole to prevent the housing from inclining.

Projected ends of the reinforcing ribs, a projected end of the terminal insertion part, and projected ends of the guide ribs projected from the fit-in part may be substantially coincident with one another.

Increasing the projected lengths of the reinforcing ribs with respect to the fit-in part enhance the strength of the reinforcing ribs. Increasing the projected lengths of the guide ribs with respect to the fit-in part further prevent the housing from inclining.

Thus, the housing will not incline and the reinforcing ribs are stronger.

The connector of the invention also may have a shielding shell that surrounds a portion of the housing that projects from the fit-in part and that is exposed outside the case and is fixed to the case. A shell contact surface preferably is provided at the fit-in part and is capable of contacting the shielding shell in a direction in which the fit-in part is fitted in the mounting hole. A notched surface may be formed by cutting out an outer edge of the shell contact surface and a water-passing gap is formed between the notched surface and the shielding shell. Thus, a water-passing gap is formed between the shielding shell and the notched surface. The water-passing gap functions as a drainage path. Thus, water that has collected between the shielding shell and the shell contact surface can be drained through the water-passing gap. Accordingly, water is not likely to collect between the shielding shell and the shell contact surface.

A notched surface may be formed throughout an entire circumference of the outer edge of the shell contact surface. Thus, the water-passing gap can be formed throughout the entire circumference of the outer edge of the shell contact surface.

A sealing ring may be provided between an inner peripheral surface of the mounting hole and a peripheral surface of the fit-in part and preferably is in close contact with the inner peripheral surface of the mounting hole and the peripheral surface of the fit-in part. The sealing ring prevents water from penetrating into the case from the mounting hole. Further the water-passing gap makes it difficult for water to collect in the gap between the inner peripheral surface of the mounting hole and the peripheral surface of the fit-in part.

The connector may have two tubular electric wire insertion parts that penetrate through the fit-in part for receiving electric wires connected to a battery. Thus, the connector can be used to supply electric power from a battery to an apparatus.

A waterproof rubber stopper may be disposed between an inner peripheral surface of the electric wire insertion part and a covered portion of the electric wire. The waterproof rubber stopper prevents water from penetrating into the case from the electric wire insertion part.

In view of the above water is not likely to collect between the shielding shell and the housing.

DETAILED DESCRIPTION OF THE PREFERRED EMBODIMENTS

Figure 1:
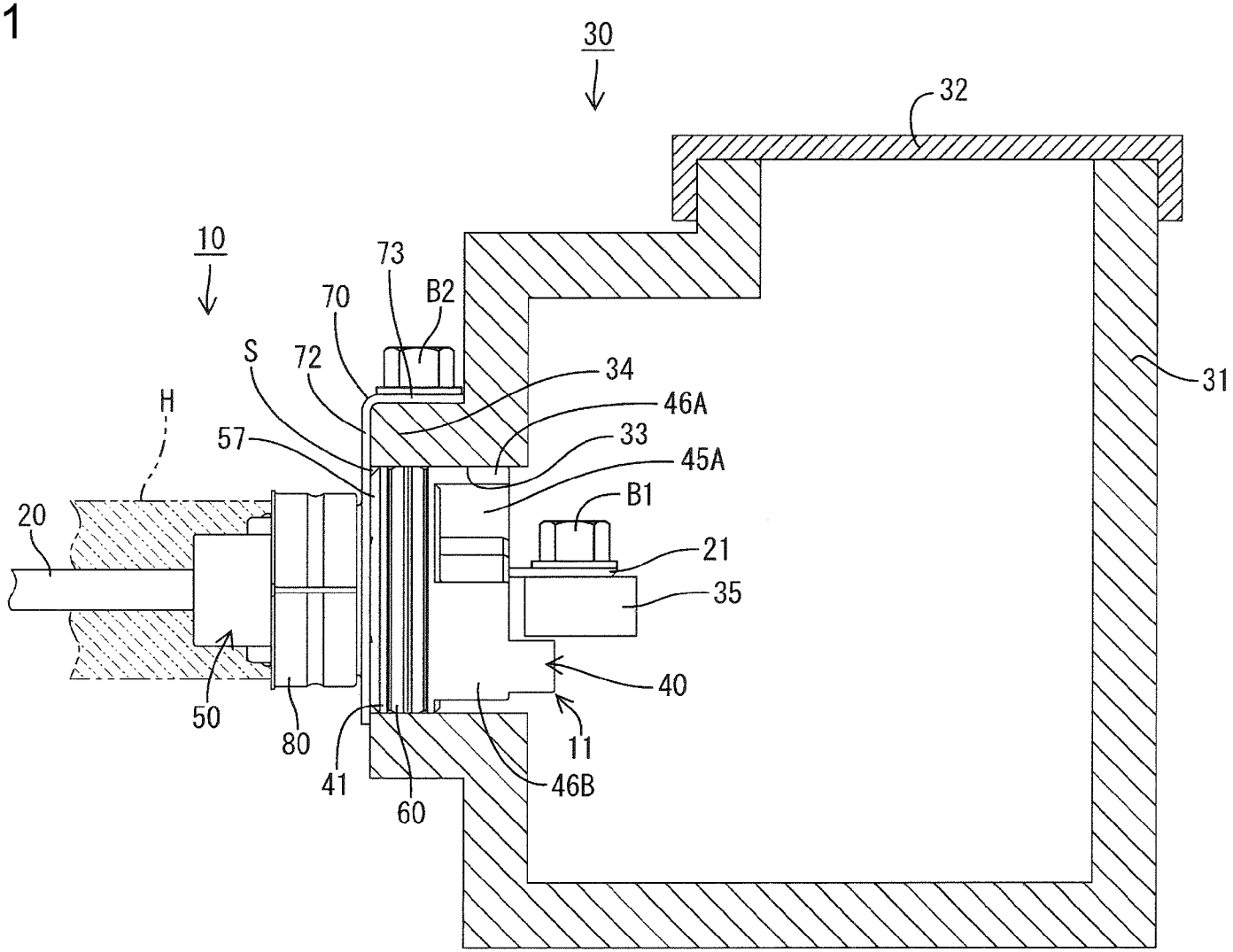
FIG. 1 is a side elevation of a connector for an apparatus, thus showing a state in which the connector is mounted on a mounting hole of a case.

A connector in accordance with the invention is identified generally by the numeral 10 in FIGS. 1 through 13. The connector 10 is for an apparatus and is mounted on an inverter of an electric car. More particularly, the connector 10 is used to supply the inverter with electric power from a battery (not shown). Therefore the connector 10 for the apparatus is connected to one end of an electric wire 20 and the other end of the electric wire 20 is connected to the battery. The inverter is not shown in the drawings, but is accommodated inside a case 30 that is made of a metal and has a shielding function.

As shown in FIG. 1, the case 30 has a main body 31 with an upper opening and an upper cover 32 that closes the upper opening of the main body 31. A mounting hole 33 penetrates through a side wall of the main body 31 and through a fit-in tubular part 34 that projects out from an outer surface of the main body 31.

Figure 4:
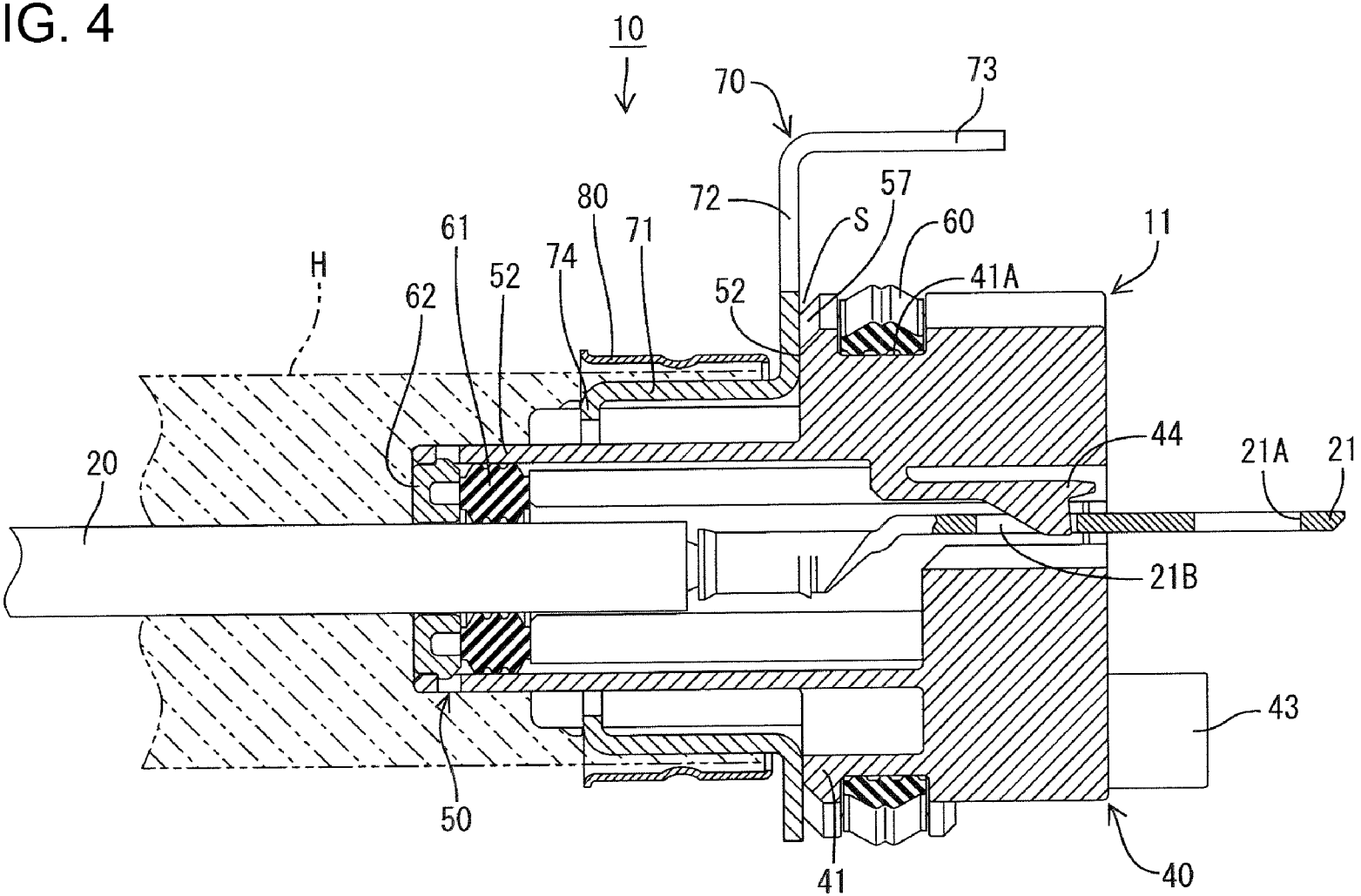
FIG. 4 is a sectional view taken along a line B-B in FIG. 5.

A terminal base 35 is disposed inside the case 30. The connector 10 also includes a terminal fitting 21 connected to the end of the electric wire 20. As shown in FIG. 4, a bolt hole 21A is formed at a tip of a terminal fitting 21. The terminal fitting 21 is connected electrically conductively to the inverter by penetrating a connection bolt B1 through the bolt hole 21A and screwing the connection bolt B1 on the terminal base 35.

The connector 10 for the apparatus has a housing 11 made of resin. More particularly, the housing 11 includes an inner housing 40 disposed inside the case 30 and an outer housing 50 disposed outside the case 30.

Figure 8:
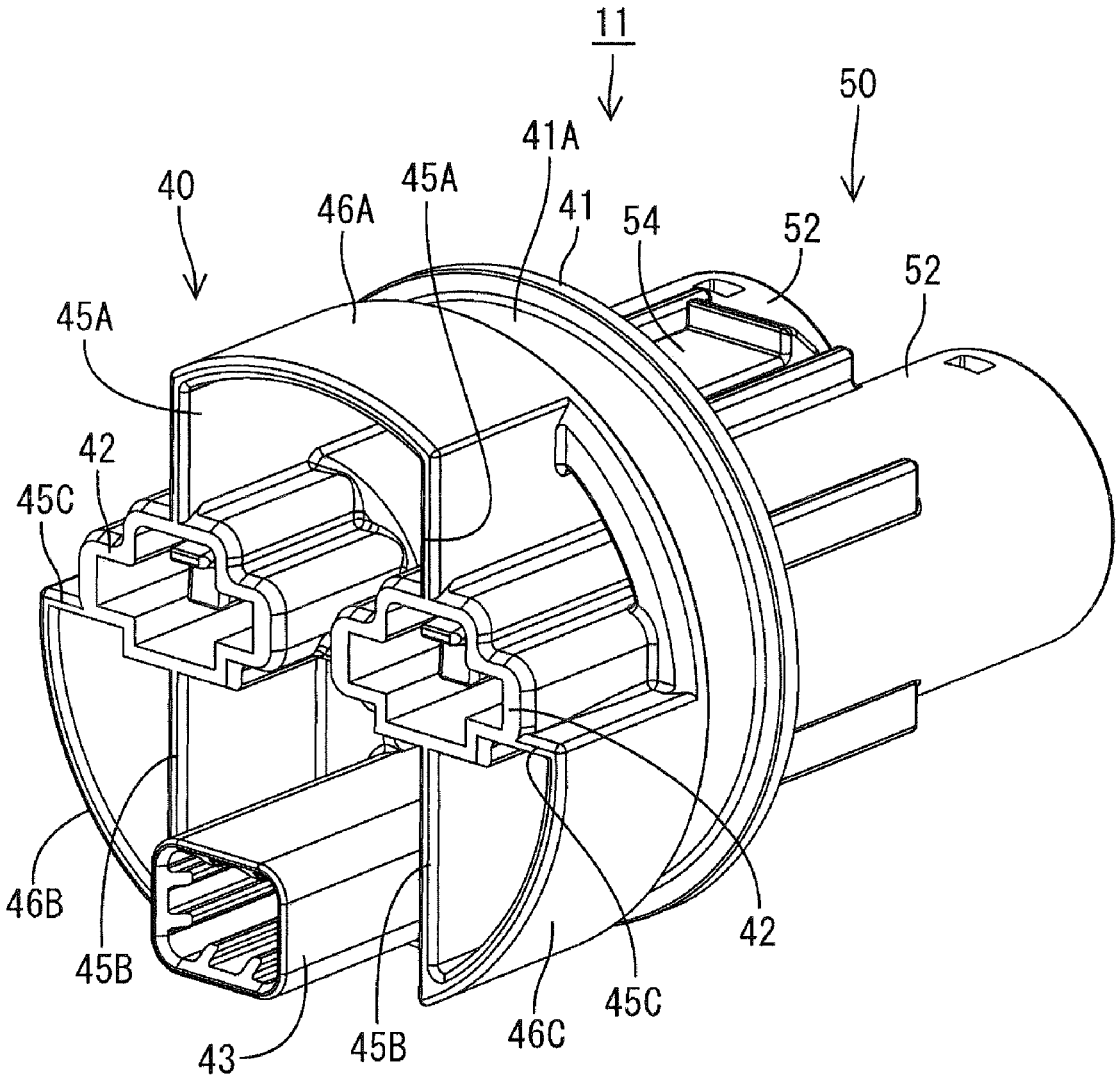
FIG. 8 is a perspective view of a housing as viewed from an inner housing.
Figure 12:
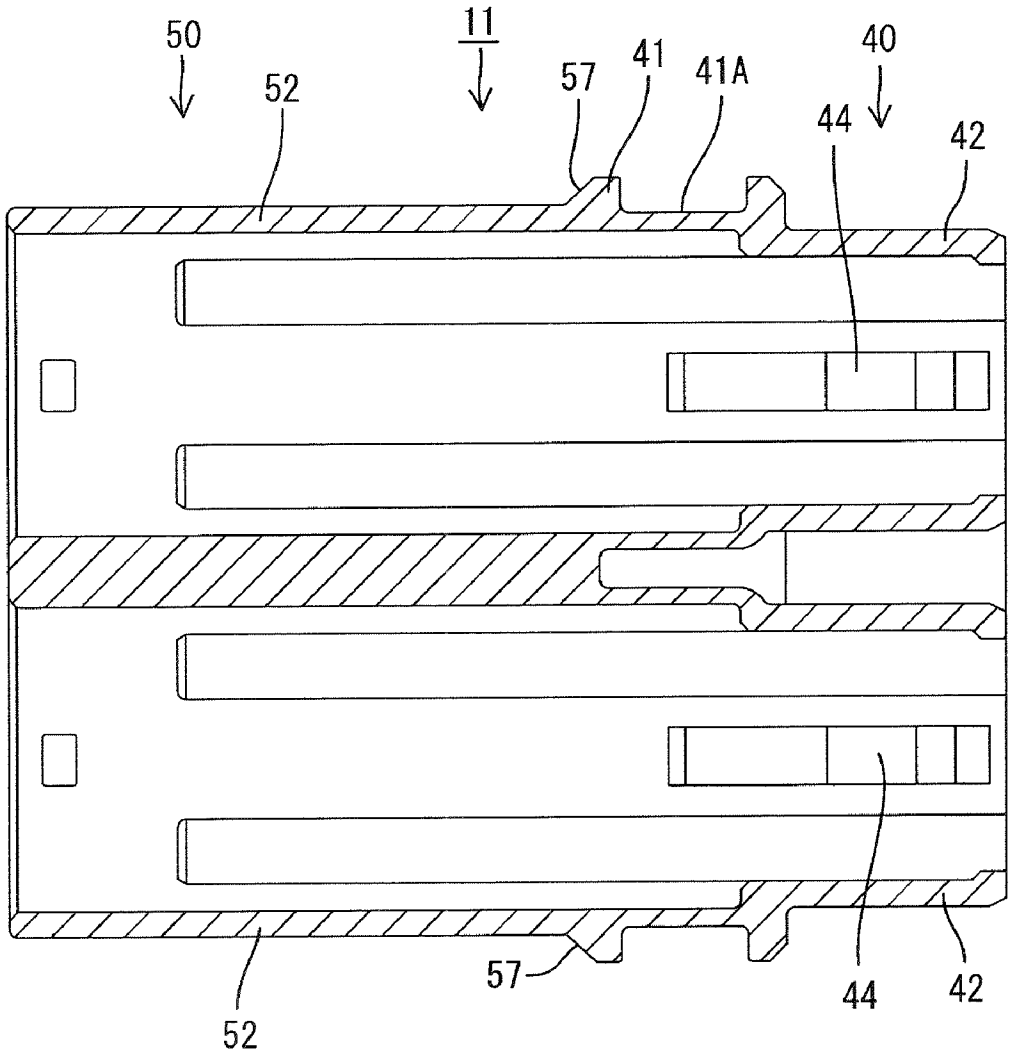
FIG. 12 is a sectional view taken along a line C-C in FIG. 9.

The inner housing 40 has a fit-in part 41 that is circular when viewed axially, as shown in FIG. 8. The fit-in part 41 is to be fit in the mounting hole 33 of the case 30. A mounting groove 41A is formed concavely on a peripheral surface of the fit-in part 41, as shown in FIG. 12.

The connector 10 also includes a sealing ring 60 made of flexible rubber. The sealing ring 60 can be fit in the mounting groove 41A and held axially in the mounting groove 41A without slipping off. The sealing ring 60 closely contacts the mounting groove 41A and an inner peripheral surface of the mounting hole 33 when the fit-in part 41 is fit in the mounting hole 33. Thus, water is prevented from penetrating into the case 30 from a gap between the fit-in part 41 and the fit-in tubular part 34.

Two terminal insertion parts 42 project from the fit-in part 41, as shown in FIG. 8. The terminal insertion parts 42 are tubes that penetrate the fit-in part 41 and project into the case 30. Each terminal insertion part 42 has a wide portion 42A for receiving the terminal fitting 21 and upper and lower narrow portions 42B that open into the wide portion 42A, as shown in FIG. 8. Thus, an inner space of the terminal insertion part 42 is approximately cross-shaped in section.

A vertically flexible lance 44 is cantilevered from a position in the upper narrow portion 42B of the terminal insertion part 42 that aligns with the fit-in part 41. The lance 44 extends toward the inner side of the case 30 and into the wide portion 42A of the terminal insertion part 42, as shown in FIG. 4. The terminal fitting 21 has a lance-locking hole 21B (see FIG. 4) and the lance 44 can engage the lance-locking hole 21B to prevent the terminal fitting 21 from slipping off toward the outside of the case 30.

Figure 3:
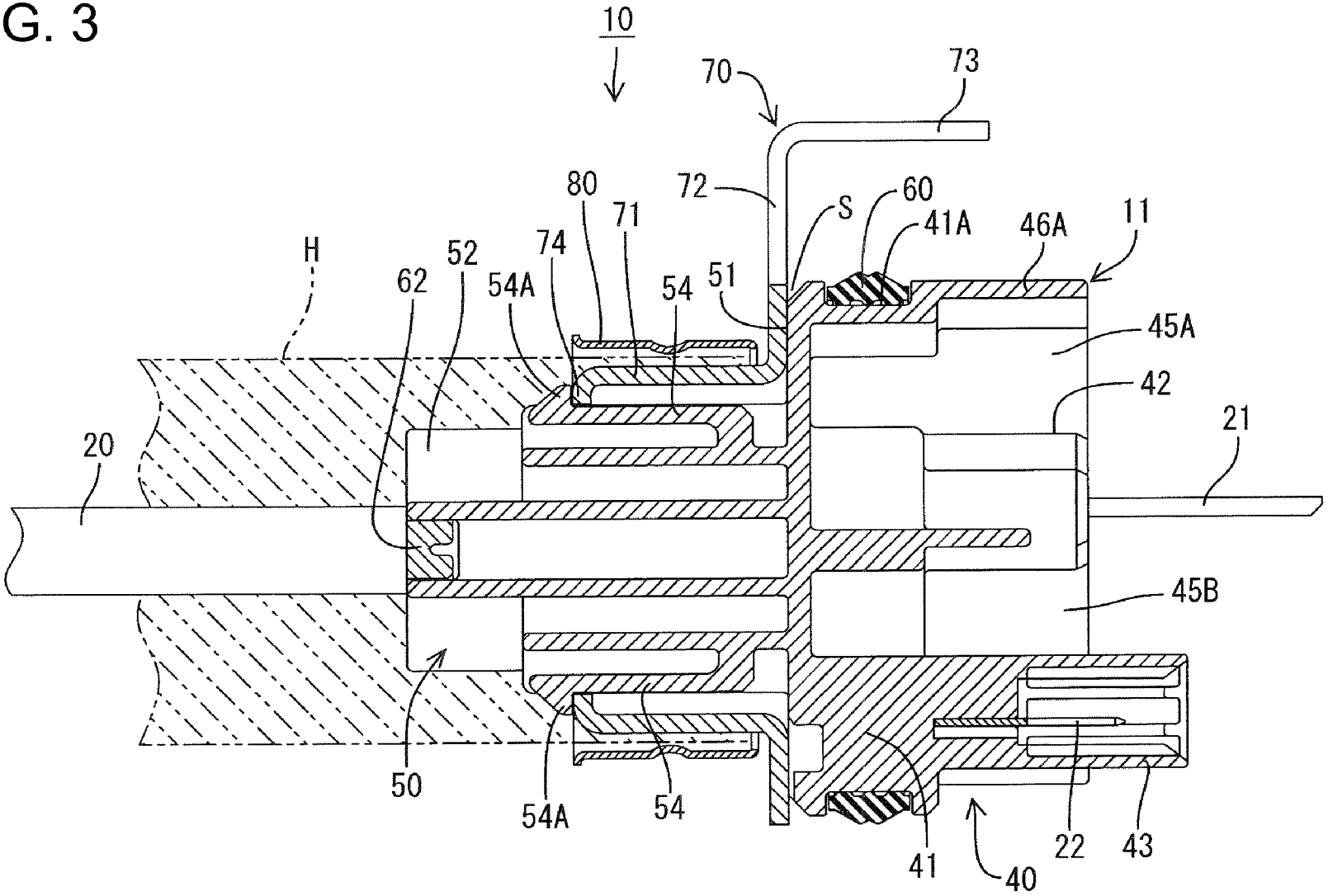
FIG. 3 is a sectional view taken along a line A-A in FIG. 5.

A detection terminal accommodation part 43 projects from a widthwise center of the fit-in part 41 and at a position below the terminal insertion parts 42, as shown in FIG. 8, and into the case 30. The detection terminal accommodation part 43 is tube that projects farther into the case 30 than the terminal insertion parts 42, as shown in FIG. 3. The fit-in detection terminal 22 is accommodated in the detection terminal accommodation part 43 and is connected to a terminal at the inverter side when the fit-in part 41 is fit in the mounting hole 33, thereby permitting detection that the fit-in part 41 has been fit in the mounting hole 33.

An upper reinforcing rib 45A extends up from an upper surface of the upper narrow portion 42B of the terminal insertion part 42 and a lower reinforcing rib 45B extends down from a lower surface of the lower narrow portion 42B of the terminal insertion part 42. A left reinforcing rib 45C extends leftward from a side surface of the wide portion 42A of the terminal insertion part 42 and a right reinforcing rib 45D extends rightward from the side surface of the wide portion 42A of the terminal insertion part 42. The reinforcing ribs 45A, 45B, 45c and 45D connect to the fit-in part 41 and prevent the housing 11 from inclining.

Outer edges of the reinforcing ribs 45A, 45B, 45C, and 45D align with an outer edge of the fit-in part 41. The projected ends of the reinforcing ribs 45A, 45B, 45C, and 45D that are opposite the fit-in part 41 align with the projected ends of the terminal insertion parts 42. Thus, the projected ends of the reinforcing ribs 45A, 45B, 45C, and 45D projected from the fit-in part 41 extend orthogonally to the direction in which the fit-in part 41 is fit in the mounting hole 33.

The above-described reinforcing ribs 45A, 45B, 45C, and 45D are stronger than reinforcing ribs with tapered guides formed at the leading and outer ends. However, the absence of tapered guides can cause the reinforcing ribs 45A, 45B, 45C, and 45D to interfere with the fit-in tubular part 34 when fitting the fit-in part 41 in the mounting hole 33. Thus, an operation of fitting the fit-in part 41 in the mounting hole 33 be performed smoothly. Accordingly, guide ribs 46A, 46B and 46C are formed separately from the reinforcing ribs 45A, 45B, 45C and 45D to guide the fit-in part 41 into the mounting hole 33.

Figure 13:
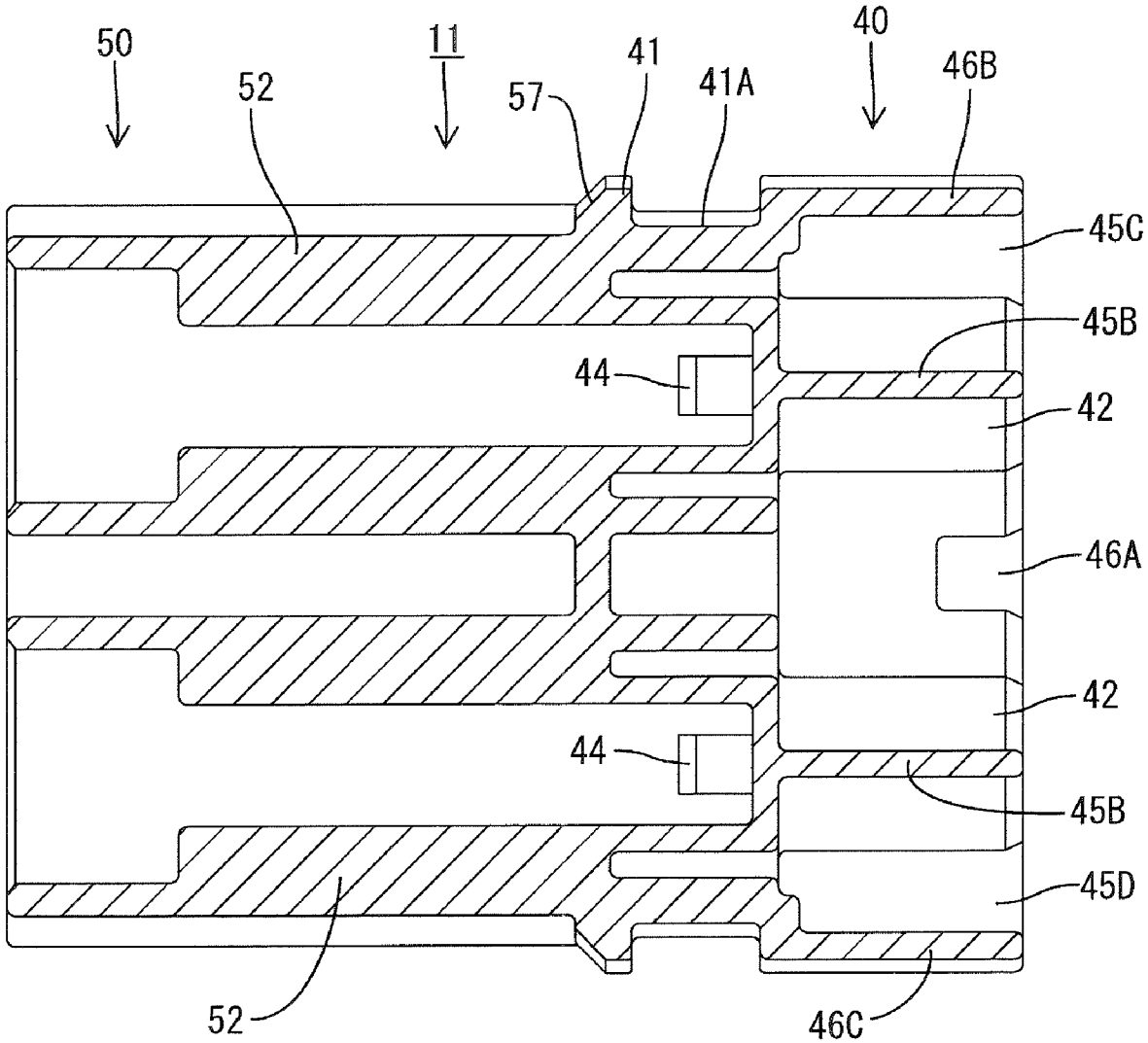
FIG. 13 is a sectional view taken along a line D-D in FIG. 9.

The guide ribs 46A, 46B, and 46C have the same outer configuration as the outer peripheral surface of the fit-in part 41 and project from the fit-in part 41 into the case 30. The guide ribs 46A, 46B and 46C are disposed intermittently in a circumferential direction along the peripheral surface of the fit-in part 41. As shown in FIG. 13, projected ends of the guide ribs 46A, 46B and 46C opposite the fit-in part 41 are coincident with the projected ends of the reinforcing ribs 45A, 45B, 45C and 45D and with the projected ends of the terminal insertion parts 42.

Figure 5:
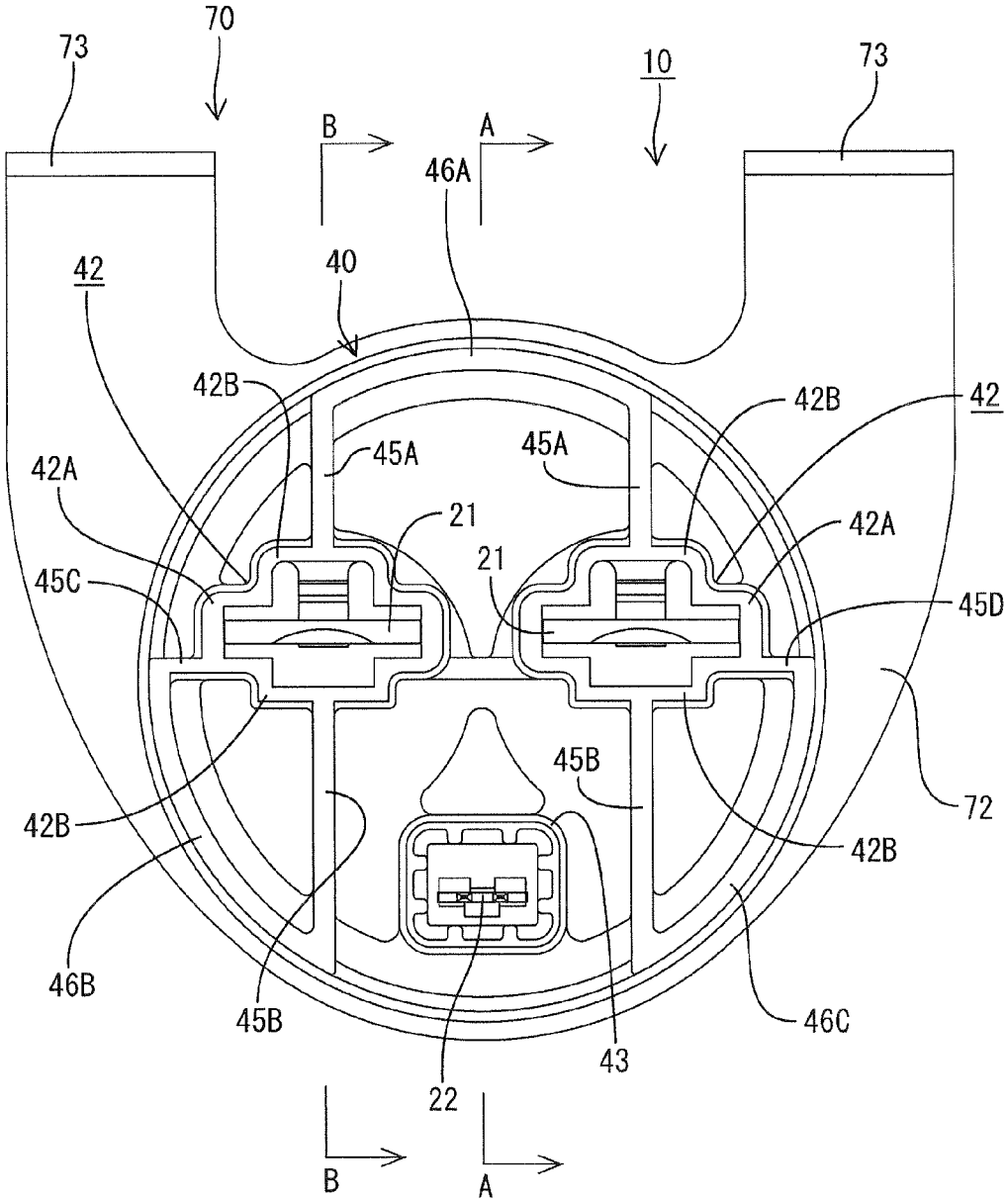
FIG. 5 is a front view showing the connector for an apparatus.

As shown in FIG. 5, the upper guide rib 46A is at the upper center of the fit-in part 41, the left guide rib 46B is at a lower left of the fit-in part 41, and the right guide rib 46C is at a lower right of the fit-in part 41. The upper guide rib 46A is a circular arc that connects upper ends of the upper reinforcing ribs 45A to each other. The left guide rib 46B is a circular arc that connects a left end of the left reinforcing rib 45C and a lower end of the left lower reinforcing rib 45B to each other. The right guide rib 46C is a circular arc that connects a right end of the right reinforcing rib 45D and a lower end of the right lower reinforcing rib 45B to each other.

The outer peripheral surfaces of the guide ribs 46A, 46B and 46C can be brought into contact with the inner peripheral surface of the mounting hole 33. Thus, the fit-in part 41 can be fit easily in the mounting hole 33 and the housing 11 will not incline. In addition, the guide ribs 46A, 46B and 46C connect the reinforcing ribs 45A, 45B, 45C, and 45D to improve the strength of the reinforcing ribs 45A, 45B, 45C, and 45D.

Figure 9:
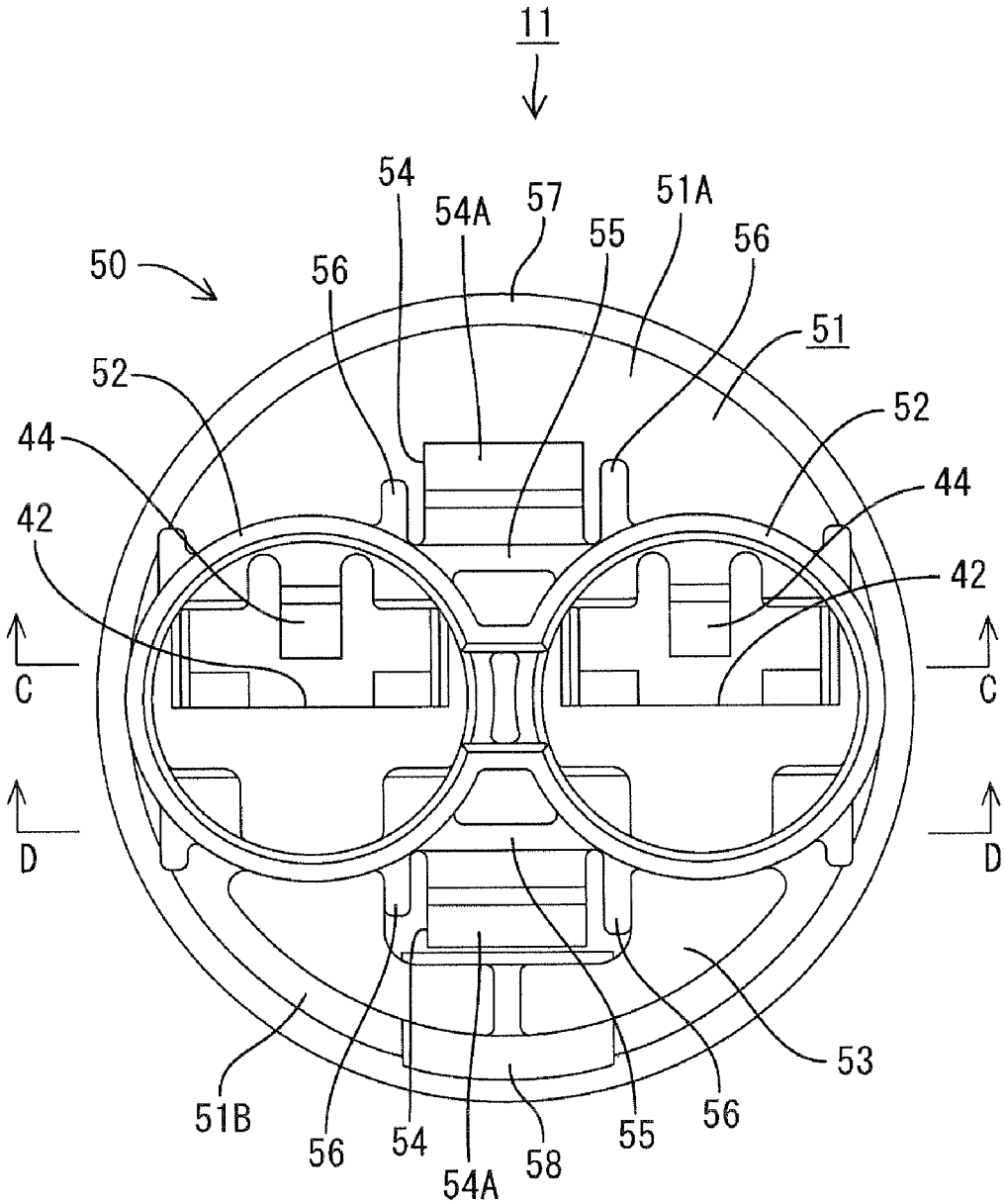
FIG. 9 is a rear view showing the housing.
Figure 10:
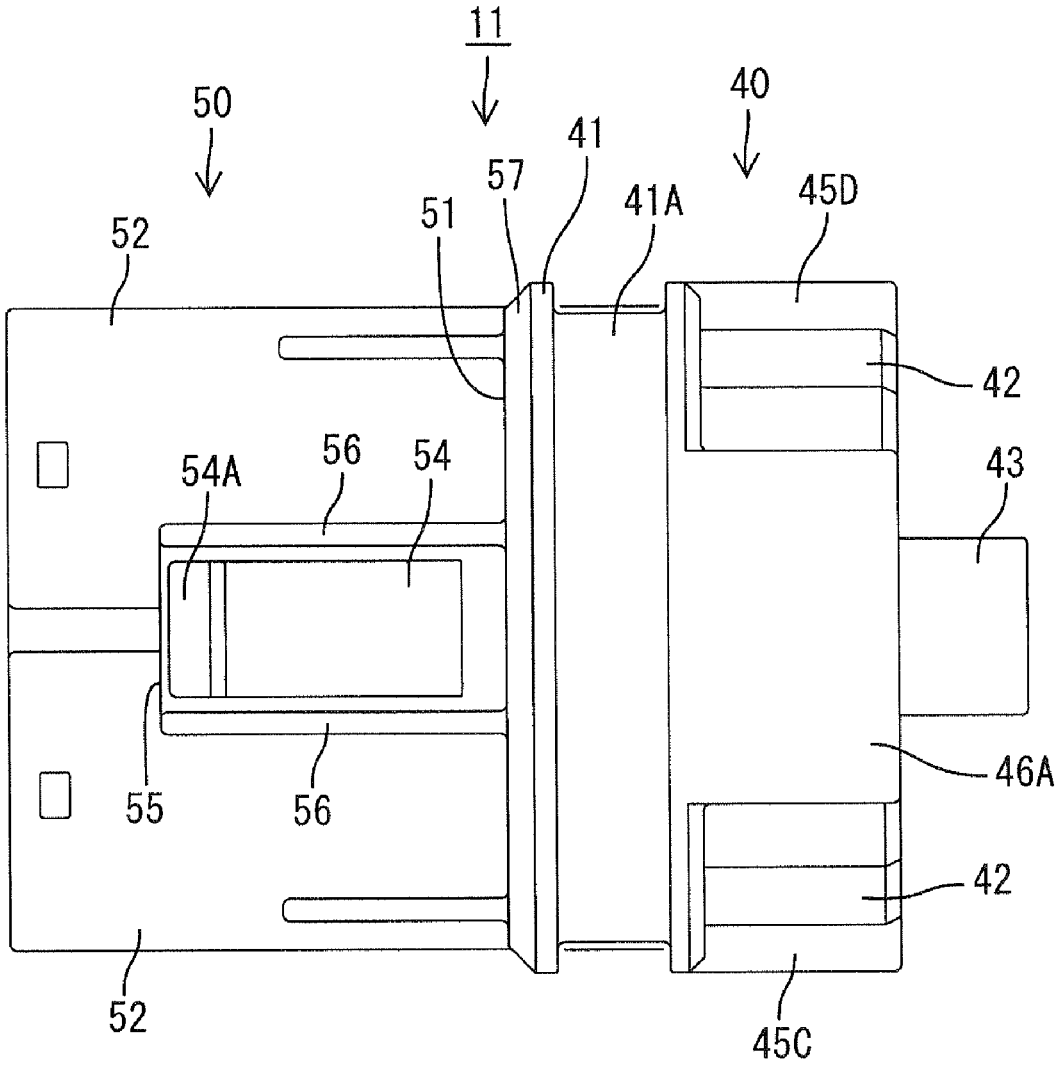
FIG. 10 is a plan view showing the housing.
Figure 11:
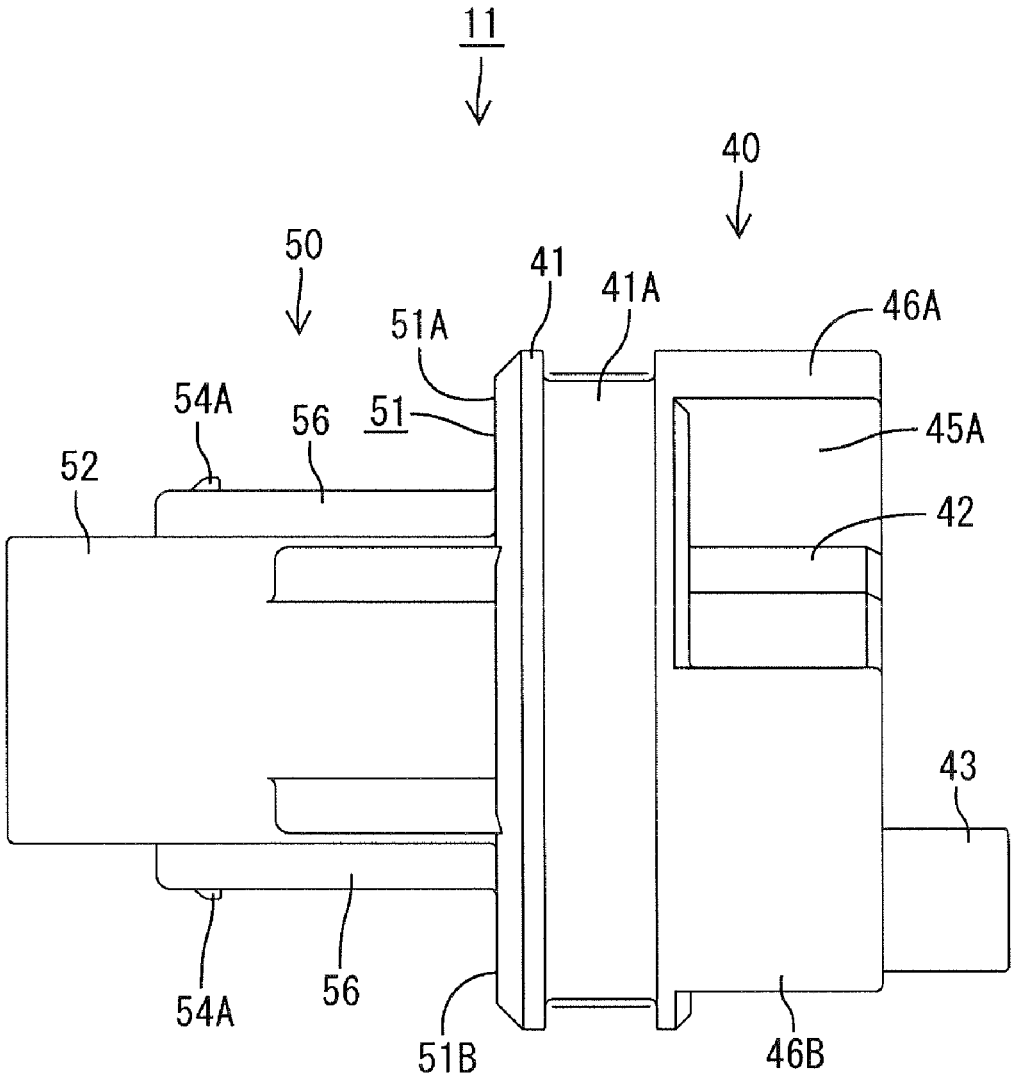
FIG. 11 is a side view showing the housing.

As shown in FIGS. 9 through 11, the outer housing 50 has a shell contact surface 51 and two cylindrical electric wire insertion parts 52. The shell contact surface 51 forms a surface of the outer side of the case 30 at the fit-in part 41

As shown in FIG. 9, the shell contact surface 51 is divided into an upper shell contact surface 51A disposed above the electric wire insertion parts 52 and a lower shell contact surface 51B disposed below the electric wire insertion parts 52. The shell contact surface 51 defines a plane orthogonal to the direction in which the fit-in part 41 is fit in the mounting hole 33. Therefore the shell contact surface 51 can contact a shielding shell 70 in the direction in which the fit-in part 41 is fit in the mounting hole 33. The lower shell contact surface 513 is formed on only a peripheral edge of the fit-in part 41. Thus, a concave part 53 is formed between is electric wire insertion parts 52 and the lower shell contact surface 51B and is concave toward the inside of the case 30.

The electric wire insertion part 52 is cylindrical and penetrates through the fit-in part 41. As shown in FIG. 12, the electric wire insertion parts 52 communicate respectively with the terminal insertion parts 42. Thus, an inner space of each electric wire insertion part 52 and an inner space of each terminal insertion part 42 form a cavity. The cavity accommodates the terminal fitting 21 connected to the end of the electric wire 20.

The shielding shell 70 is made of metal and has a shielding function when mounted on the outer housing 50. As shown in FIGS. 1 through 4, the shielding shell 70 has a tubular part 71, a base part 72 surrounding a peripheral portion of both electric wire insertion parts 52, a base 72 disposed along the shell contact surface 51 and an outer surface of the main body 31 of the case 30, fixed to an upper surface of the fit-in tubular part 34. The tubular part 71, the base part 72, and the fixed part 73 are formed unitarily.

Figure 6:
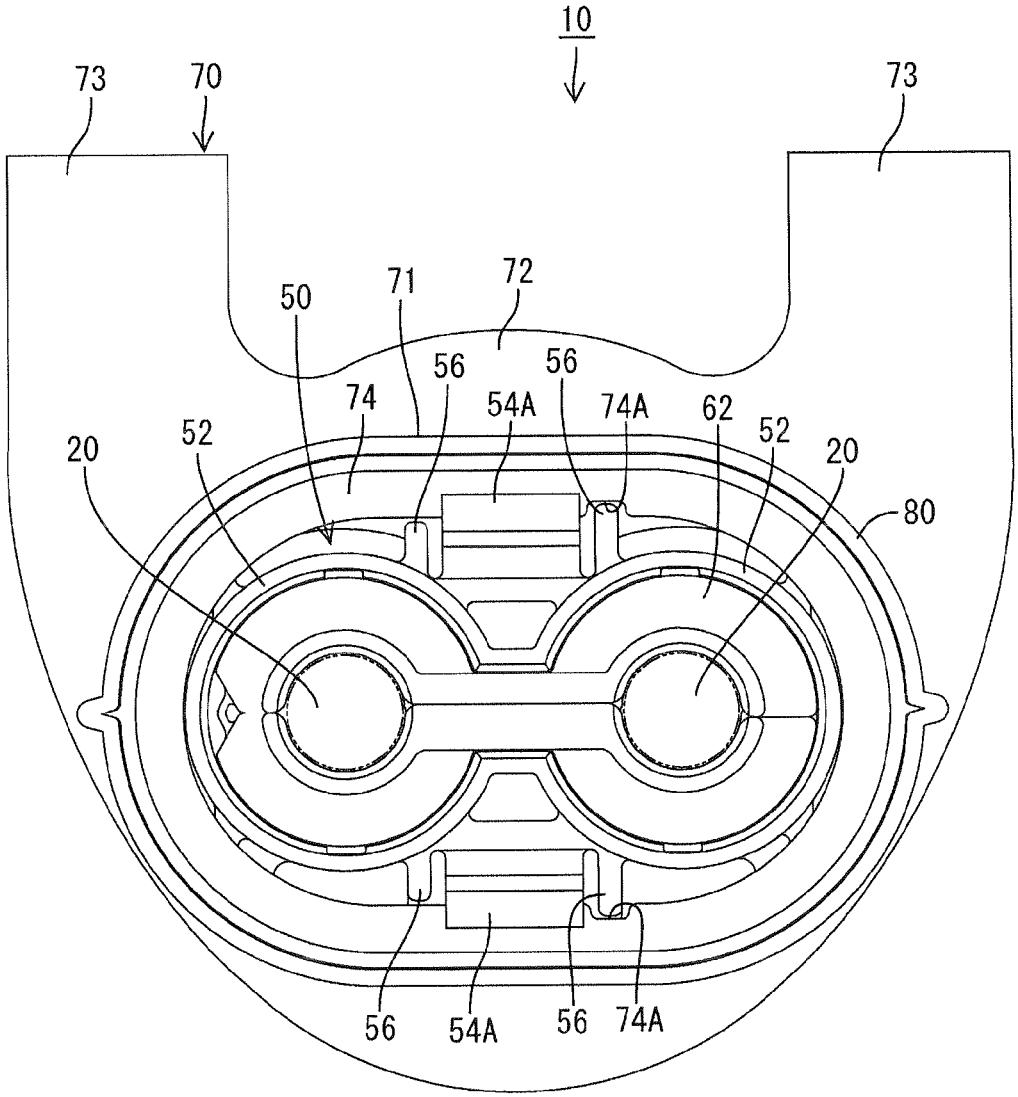
FIG. 6 is a rear view showing the connector for an apparatus.

As shown in FIG. 6, the tubular part 71 is horizontally wide in a sectional view and a flange 74 projects inward at the tip of the tubular part 71, as shown in FIG. 3. A horizontally wide insertion hole is inward of the flange 74 and the electric wire insertion parts 52 are inserted therethrough.

Locking parts 54 (see FIG. 3) are cantilevered from bases 55 that are sandwiched in a dead space between peripheral surfaces of the electric wire insertion parts 52 of the outer housing 50. The free end of each cantilevered locking part 54 projects outside the case 30 and includes a locking projection 54A that projects away from the base 55, as shown in FIGS. 3 and 9. The locking projections 54A lock to upper and lower edges of the flange 74 when the tubular part 71 is mounted on the peripheral surfaces of the electric wire insertion parts 52, thereby fixing the shielding shell 70 to the outer housing 50.

Two protection walls 56 project from each base 55 and are disposed at left and right sides of the locking part 54. Thus, the locking part 54 is sandwiched between the left and right protection walls 56. The heights of the upper and lower right protection walls 56 from the base 55 exceed the heights of the upper and lower left protection walls 56. The flange 74 has upper and lower notches 74A that correspond to the upper and lower right protection walls 56, as shown in FIG. 6. Thus, the upper and lower right protection walls 56 fit in the upper and lower notches 74A respectively as the shielding shell 70 is mounted on the outer housing 50, thereby preventing the shielding shell 70 from being mounted erroneously on the outer housing 50.

As shown in FIG. 4, a waterproof rubber stopper 61 is disposed between an inner peripheral surface of the electric wire insertion part 52 and a covered portion of the electric wire 20. The rubber stopper 61 closely contacts the inner peripheral surface of the electric wire insertion part 52 and the covered portion of the electric wire 20. A rubber stopper holder 62 prevents the rubber stopper 61 from being removed from the electric wire insertion part 52 and the electric wire 20. Thus, water cannot penetrate into the case 30 from the electric wire insertion part 52.

As shown in FIG. 3, an end region of a braided wire H covers a peripheral surface of the tubular part 71 and a caulking ring 80 covers the end region of the braided wire H. The caulking ring 80 is crimped to the tubular part 71 to collectively seal a space extending from the inside of the case 30 to the inside of the braided wire H.

As shown in FIGS. 1 and 6, fixed parts 73 project up from both sides of the base 72 and thereafter are bent approximately orthogonally so that the fixed parts 73 extend along an upper surface of the fit-in tubular part 34. A bolt hole is formed at a portion of the upper surface of the fit-in tubular part 34. The shielding shell 70 is fixed to the case 30 by penetrating a fixing bolt B2 through the bolt hole and screwing the fixing bolt B2 on an upper portion of the fit-in tubular part 34.

The base 72 and the shell contact surface 51 are in close contact when the shielding shell 70 is fixed to the case 30. However, the fit-in part 41 could be fit deeply in the mounting hole 33 or the base 72 of the shielding shell 70 could be fixed to the outer housing 50 with the base 72 of the shielding shell 70 spaced from the shell contact surface 51 to form a gap, and water could collect easily in the slight gap.

Figure 2:
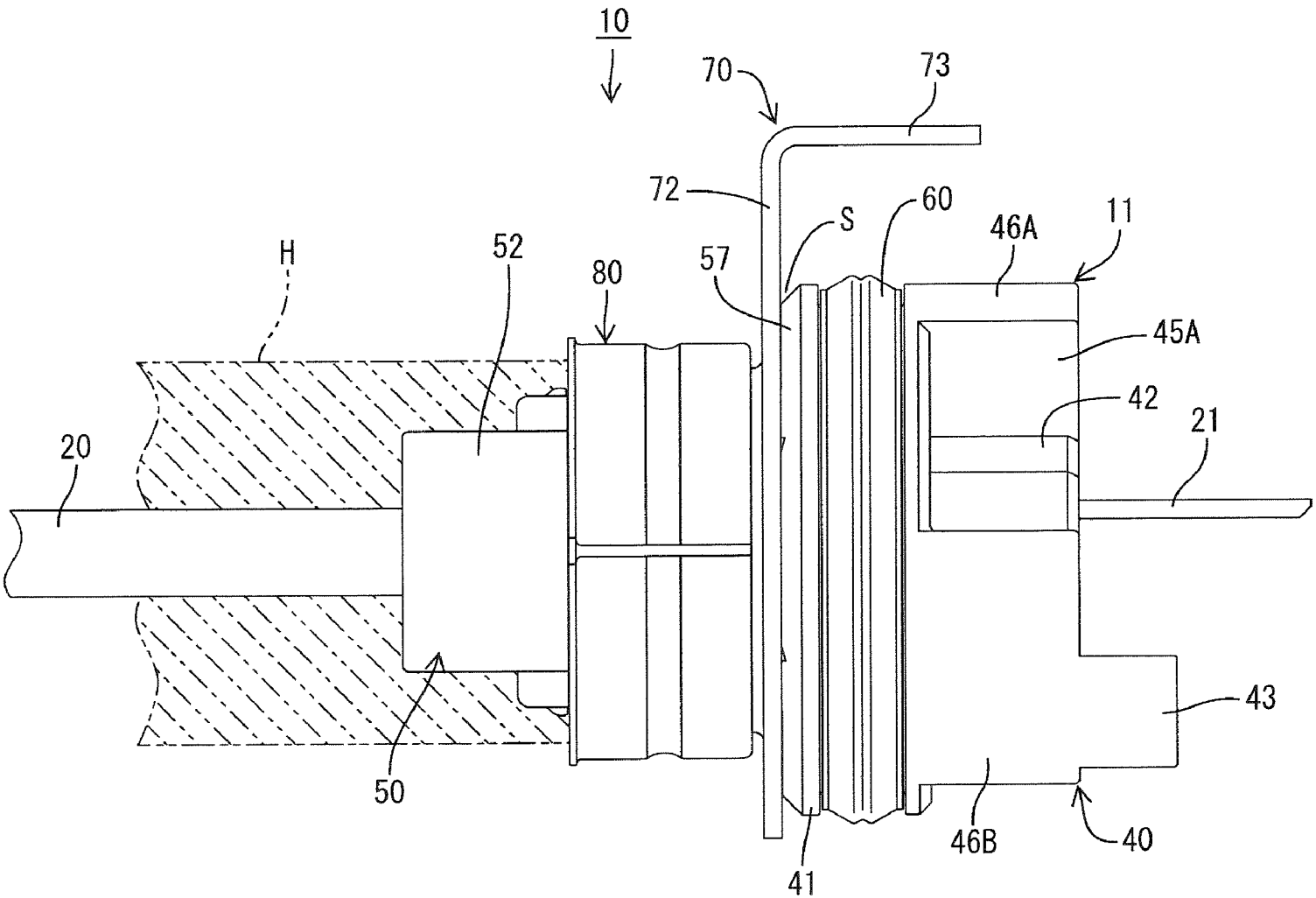
FIG. 2 is a side elevation of the connector for an apparatus.

To solve this problem, a notched surface 57 is formed by cutting out an outer edge of the shell contact surface 51 to define a gap S between the notched surface 57 and the base 72, as shown in FIGS. 9 and 10. The gap S, as shown in FIGS. 2, 3 and 4, defines a water drain path so that water will not collect between the base part 72 and the shell contact surface 51.

Figure 7:
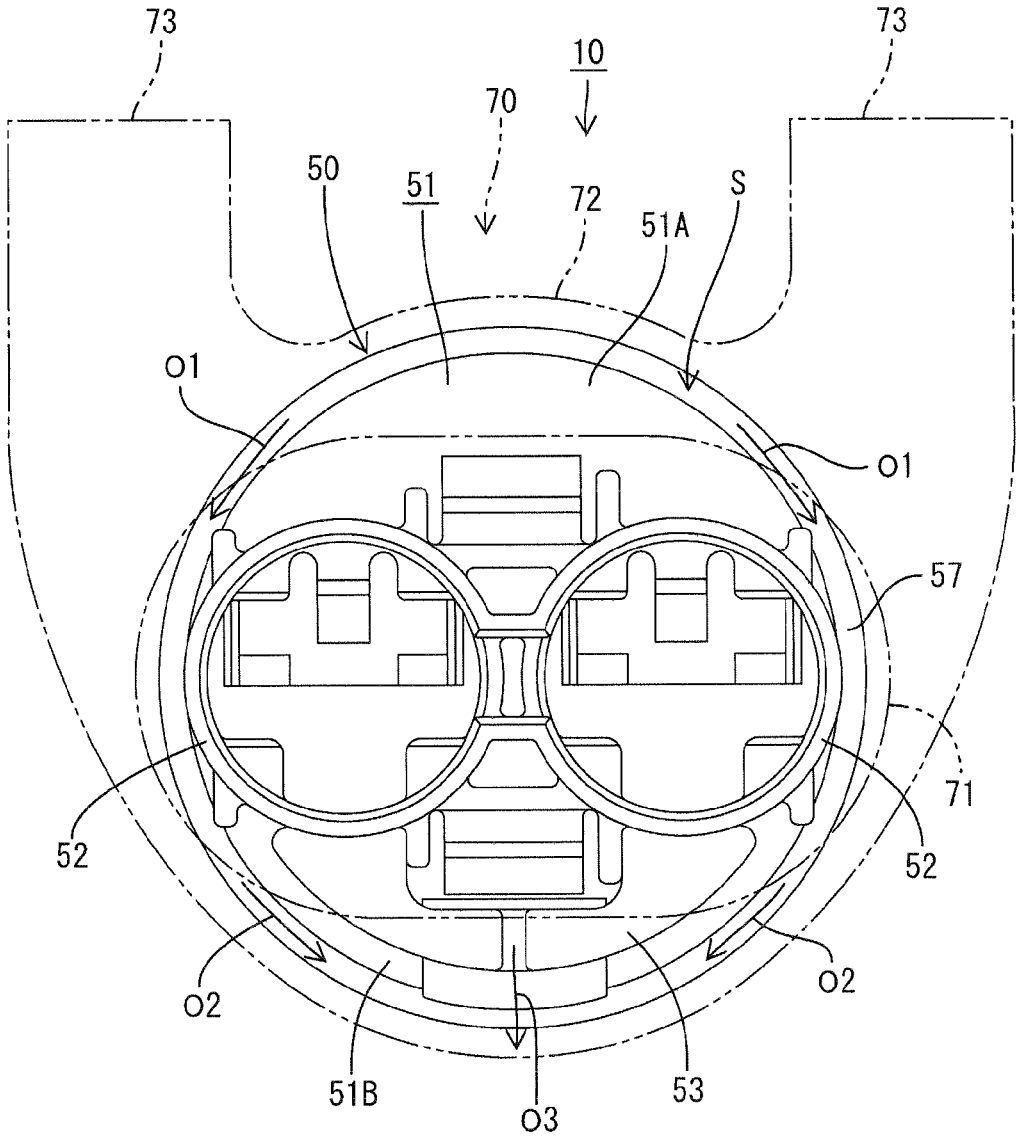
FIG. 7 shows a drainage path at a shell contact surface.

A drainage path for draining water to the outside is described below with reference to FIG. 7. Reference numeral O1 in FIG. 7 denotes a first drainage path for draining water that has collected between the shielding shell 70 and the outer housing 50. Reference numeral O2 in FIG. 7 denotes a second drainage path. Reference numeral O3 in FIG. 7 denotes a third drainage path. Water that has flowed from an upper portion of the fit-in part 41 preferentially flows through the first drainage path O1, because the gap S is wider than a gap between the base part 72 and the upper shell contact surface 51A. Water that has flowed through the first drainage path O1 flows to the second drainage path O2 through the notched surface 57. If the water that has flowed through the first drainage path O1 flows into the tubular part 71, the water flows to the concave part 53 through the peripheral surface of the electric wire insertion part 52. A drainage concave portion 58 functioning as the third drainage path O3 is formed concavely at a lower portion of the lower shell contact surface 51B, as shown in FIG. 9. Therefore, water that has collected in the concave part 53 is drained outside from the third drainage path O3. Accordingly, water cannot readily collect between the shielding shell 70 and the outer housing 50.

Initially, the connected assembly of the terminal fitting 21 and the electric wire 20 is inserted into the electric wire insertion part 52 and into the terminal insertion part 42. The lance 44 then locks to the locking hole 21B of the terminal fitting 21 to prevent removal of the terminal fitting 21 from the connector 10. The shielding shell 70 then is mounted on the outer housing 50 with the notch 74A of the flange 74 fit on the right protection wall 56. Sufficient pushing of the shielding shell 70 enables the inner peripheral side of the locking projection 54A to engage the flange 74 to hold the shielding shell 70 on the outer housing 50.

The braided wire H is placed on the peripheral surface of the tubular part 71 and the caulking ring 80 is crimped to the peripheral surface the tubular part 71 by caulking. The housing 11 then is mounted on the case 30. More particularly, the fit-in part 41 is fit into the mounting hole 33 and the peripheral surfaces of the guide ribs 46A, 46B and 46C slide in contact with the inner peripheral surface of the mounting hole 33. Thus the fit-in part 41 is guided into the mounting hole 33 and prevents the housing 11 from inclining.

The bolt hole 21A of the terminal fitting 21 is disposed on the upper surface of the terminal base 35 when the fit-in part 41 is inserted to a predetermined fit-in position of the mounting hole 33. The connection bolt B1 then is inserted into the bolt hole 21A and is tightened into the terminal base 35 to connect the terminal fitting 21 and the inverter electrically conductively to each other. The fixing bolt B2 then fixes the fixed part 73 of the shielding shell 70 to the upper surface of the fit-in tubular part 34 for fixing the shielding shell 70 to the case 30.

There is a possibility that a slight gap will exist between the upper shell contact surface 51A and the base 72 when the shielding shell 70 is fixed to the case 30. Water can flow into the slight gap from the upper portion of the fit-in part 41. However, the water preferentially passes through the gap S between the notched surface 57 and the base 72 and is drained outside through the first drainage path O1 and the second drainage path O2. Therefore it is difficult for the water to collect in the slight gap between the upper shell contact surface 51A and the base 72. Water that flows into the concave part 53 is drained outside through the third drainage path O3. Therefore it is difficult for the water to collect between the shielding shell 70 and the housing 11.

As described above, the guide ribs 46A, 46B and 46C guide the fit-in part 41 into the mounting hole 33 and prevent the housing 11 from inclining. The guide ribs 46A, 46B and 46C extend unitarily between the reinforcing ribs 45A, 45B, 45C and 45D to improve the strength of the reinforcing ribs 45A, 45B, 45C and 45D. The guide ribs 46A, 46B, and 46C have the same outer configuration as the peripheral surface of the fit-in part 41 and to guide the guide ribs 46A, 46B, and 46C to the inner peripheral surface of the mounting hole 33 and easy to prevent the housing 11 from inclining.

The projected ends of the reinforcing ribs 45A, 45B, 45C and 45D, the projected end of the terminal insertion part 42 and the projected ends of the guide ribs 46A, 46B and 46C all project from the fit-in part 41 and are coincident with one another. Thus, the lengths of the reinforcing ribs 45A, 45B, 45C and 45D and the lengths of the guide ribs 46A, 46B, and 46C can be increased to increase the strength of the reinforcing ribs 45A, 45B, 45C, and 45D and to prevent the housing from inclining to a higher extent.

The gap S for passing water therethrough makes it difficult for water to collect between the shielding shell 70 and the housing 11. The notched surface 57 is formed throughout the entire circumference of the shell contact surface 51, so that the gap S is defined around the entire circumference of the shell contact surface 51 to enhance water drain efficiency. The sealing ring 60 closely contacts the inner peripheral surface of the mounting hole 33 and the peripheral surface of the fit-in part 41 to prevent water from penetrating into the case 30. Further the gap S for passing water therethrough makes it difficult for water to collect in the gap between the inner peripheral surface of the mounting hole 33 and the peripheral surface of the fit-in part 41. Furthermore, the electric wire insertion parts 52 accommodate the electric wires 20 connected to the battery. Thus, the connector 10 can be used as a power supply connector. The waterproof rubber stopper 61 is disposed between the inner peripheral surface of the electric wire insertion part 52 and the covered portion of the electric wire 20 to prevent water from penetrating into the case 30 from the electric wire insertion part 52.

The invention is not limited to the embodiments described above with reference to the drawings. For example, the following embodiments are included in the technical scope of the present invention.

The guide ribs 46A, 46B, and 46C have a circular arc surface, but guide ribs each having a plane surface may be provided in the present invention. Guide ribs having a circular arc surface may be provided inward from the peripheral surface of the fit-in part 41.

The projected ends of the reinforcing ribs 45A, 45B, 45C and 45D, the projected end of the terminal insertion part 42, the projected ends of the guide ribs 46A, 46B and 46C all project from the fit-in part 41 and are coincident with one another. However, the projected ends do not necessarily have to be coincident with one another in the present invention.

The notched surface 57 is tapered in the above-described embodiment. However, the notched surface 57 may be curved or L-shaped.

The base 72 of the shielding shell 70 is inclose contact with the shell contact surface 51 in the above-described embodiment. However, the base 72 does not have to contact the shell contact surface 51.

The notched surface 57 is formed throughout the entire circumference of the outer edge of the shell contact surface 51 in the above-described embodiment. However, the notched surface 57 may be formed at only a portion of the outer edge of the shell contact surface 51.

The above-described connector is used for an apparatus connected to a battery. However, the connector may be used as a connector for an apparatus connected to a motor.

The waterproof rubber stoppers 61 are mounted separately between the inner peripheral surface of the electric wire insertion part 52 and the covered portion of the electric wire 20. However, a waterproof rubber stopper composed of two waterproof rubber stoppers 61 integral with each other may be mounted on both electric wire insertion parts 52.

What is claimed is:

1. A connector comprising:

a housing having a fit-in part to be fit in a mounting hole that penetrates through a case of an apparatus;

at least one tubular terminal insertion part penetrating through the fit-in part for receiving at least one terminal fitting connected with an end of an electric wire;

guide ribs projecting from said fit-in part into said case, said guide ribs being disposed circumferentially intermittently along an inner peripheral surface of said mounting hole; and reinforcing ribs projecting into said case, each of the reinforcing ribs extending between an edge of one of the guide ribs and a peripheral surface of the terminal insertion part.

2. The connector of claim 1, wherein said guide ribs and a peripheral surface of said fit-in part have substantially identical configurations.

3. The connector of claim 2, wherein projected ends of said reinforcing ribs, projected ends of said terminal insertion part, and projected ends of the guide ribs projecting from the fit-in part are substantially coincident with one another.

4. The connector of claim 1, wherein the at least one terminal insertion part comprises two terminal insertion parts.

5. The connector of claim 1, wherein the fit-in part has a substantially cylindrical outer peripheral surface and the guide ribs are substantially cylindrical sections aligned with the outer peripheral surface of the fit-in part.

6. The connector of claim 5, wherein each of the reinforcing ribs is unitary with one of the guide ribs.

7. The connector of claim 5, wherein each of the guide ribs is unitary with two of the reinforcing ribs.

8. The connector of claim 2, wherein the reinforcing ribs, the terminal insertion part the guide ribs project substantially equal distances from the fit-in part.

9. A connector comprising:

a housing having a fit-in part to be fitted in a mounting hole that penetrates through a case of an apparatus;

a shielding shell surrounding a portion of that the housing projecting from the fit-in part and outside the case, the shielding shell being fixed to the case;

a shell contact surface being provided at the fit-in part and contacting the shielding shell in a direction in which the fit-in part is fitted in the mounting hole; and a notched surface formed by cutting out an outer edge of the shell contact surface and forms a water-passing gap between the notched surface and the shielding shell and a drainage concave portion formed concavely at a lower portion of the shell contact surface and extending to locations exteriorly of the shielding shell and the housing.

10. The connector of claim 9, wherein the notched surface is formed throughout an entire circumference of the outer edge of said shell contact surface.

11. The connector of claim 9, wherein a sealing ring is provided between an inner peripheral surface of the mounting hole and a peripheral surface of the fit-in part with the sealing ring being in close contact with the inner peripheral surface of the mounting hole and the peripheral surface of said fit-in part.

12. The connector of claim 9, further comprising two substantially cylindrical electric wire insertion parts that penetrate through the fit-in part for receiving electric wires connected to a battery.

13. The connector of claim 12, further comprising a waterproof rubber stopper disposed between an inner peripheral surface of said electric wire insertion part and a covered portion of the electric wire.

14. The connector of claim 9, wherein the case has a fit-in tubular part with an end surface orthogonal to a direction in which the fit-in part is fit in the mount hole and an outer circumferential surface surrounding the fit-in tubular part, the shielding shell having a base in surface-to-surface contact with the end surface of the fit-in tubular part and a fixed part projecting orthogonally from the base and fixed to the outer circumferential surface of the fit-in tubular part.

* * * * *